US008985397B2

(12) United States Patent
Lord

(10) Patent No.: US 8,985,397 B2
(45) Date of Patent: Mar. 24, 2015

(54) SYSTEMS AND METHODS FOR SPRAYING AN AEROSOL

(71) Applicant: Guardian 8 Corporation, Scottsdale, AZ (US)

(72) Inventor: Charles Scott Lord, Scottsdale, AZ (US)

(73) Assignee: Guardian 8 Corporation, Scottsdale, AZ (US)

( * ) Notice: Subject to any disclaimer, the term of this patent is extended or adjusted under 35 U.S.C. 154(b) by 0 days.

(21) Appl. No.: 13/791,582

(22) Filed: Mar. 8, 2013

(65) Prior Publication Data

US 2014/0252027 A1 Sep. 11, 2014

(51) Int. Cl.

| | |
|---|---|
| ***B67D 7/84*** | (2010.01) |
| ***F41H 9/10*** | (2006.01) |
| ***G08B 21/02*** | (2006.01) |

(52) U.S. Cl.

CPC . *F41H 9/10* (2013.01); *G08B 21/02* (2013.01)
USPC ..... 222/162; 222/1; 222/39; 222/79; 222/182; 222/325; 222/402.1; 222/402.11

(58) Field of Classification Search

CPC ..... F21V 33/0076; F41H 9/10
USPC ..... 222/39, 473, 469, 402.15, 474, 174, 222/162, 612, 1, 113, 183, 192, 258, 394, 222/472, 79, 30, 182, 325, 402.1, 402.11; 124/74, 16, 76; 239/532, 280, 1
See application file for complete search history.

(56) References Cited

U.S. PATENT DOCUMENTS

| | | | | | |
|---|---|---|---|---|---|
| 3,700,144 | A | | 10/1972 | Smrt | |
| 3,841,526 | A | * | 10/1974 | Haskins | 222/79 |
| 3,869,089 | A | | 3/1975 | Karasa | |
| 4,087,048 | A | | 5/1978 | Smrt | |
| 4,288,036 | A | | 9/1981 | Jubinville | |
| 4,454,963 | A | * | 6/1984 | Fegley | 222/5 |
| 4,545,531 | A | * | 10/1985 | Williams | 239/150 |
| 4,603,794 | A | | 8/1986 | DeFord | |
| 4,606,501 | A | | 8/1986 | Bate | |
| 4,934,393 | A | | 6/1990 | Lighthall | |
| 4,946,104 | A | | 8/1990 | Smrt | |
| 5,103,366 | A | * | 4/1992 | Battochi | 361/232 |
| 5,121,884 | A | | 6/1992 | Noakes | |
| 5,145,115 | A | | 9/1992 | Denton | |
| 5,184,778 | A | | 2/1993 | Noakes | |
| 5,221,050 | A | * | 6/1993 | Jeffries et al. | 239/708 |
| 5,287,998 | A | | 2/1994 | Smrt | |
| 5,318,208 | A | | 6/1994 | van der Wal | |
| 5,397,029 | A | * | 3/1995 | West | 222/79 |
| 5,476,192 | A | * | 12/1995 | Julinot | 222/78 |

(Continued)

*Primary Examiner* — Frederick C Nicolas
*Assistant Examiner* — Bob Zadeh
(74) *Attorney, Agent, or Firm* — Lawrence Letham; Letham Law Firm LLC; William R. Bachand

(57) ABSTRACT

A system for spraying, according to various aspects of the present invention, includes a shuttle and a trigger switch. The shuttle and the trigger switch cooperate with discontinuous mechanical coupling. The trigger switch provides a discontinuity in bias against operation of the trigger switch by the user. Consequently, the user experiences tactile feedback before spray is released. Prior to tactile feedback, the system establishes a communication link. When spray is released, the system transmits a notice via the communication link. Such a system when equipped with pepper spray aerosol is advantageous for self-defense.

23 Claims, 8 Drawing Sheets

(56) References Cited

U.S. PATENT DOCUMENTS

| | | | | |
|---|---|---|---|---|
| 5,476,195 | A | 12/1995 | Oder | |
| 5,538,164 | A | 7/1996 | Rivas | |
| 5,629,679 | A * | 5/1997 | Cranford et al. | 340/574 |
| 6,052,051 | A * | 4/2000 | Whalen | 340/425.5 |
| 6,237,461 | B1 * | 5/2001 | Poole | 89/1.11 |
| 6,622,943 | B2 | 9/2003 | Poisson | |
| 6,962,151 | B1 | 11/2005 | Knoch | |
| 7,631,506 | B2 | 12/2009 | DuBrucq | |
| 7,871,016 | B2 | 1/2011 | Ricciardi | |
| 8,177,142 | B2 | 5/2012 | Ricciardi | |
| 8,240,304 | B2 | 8/2012 | Thoemmes | |
| 2006/0201964 | A1 * | 9/2006 | DiPerna et al. | 222/78 |
| 2010/0012679 | A1 * | 1/2010 | Brownlee | 222/52 |
| 2012/0118990 | A1 * | 5/2012 | Beever, III | 239/1 |

* cited by examiner

SYSTEMS AND METHODS FOR SPRAYING AN AEROSOL

BRIEF DESCRIPTION OF THE DRAWING

Embodiments of the present invention will be described with reference to the drawing, wherein like designations denote like elements, the terms left and right are from the perspective of a user looking in the direction of spray, and.

DETAILED DESCRIPTION OF THE PREFERRED EMBODIMENTS

Figure 1:
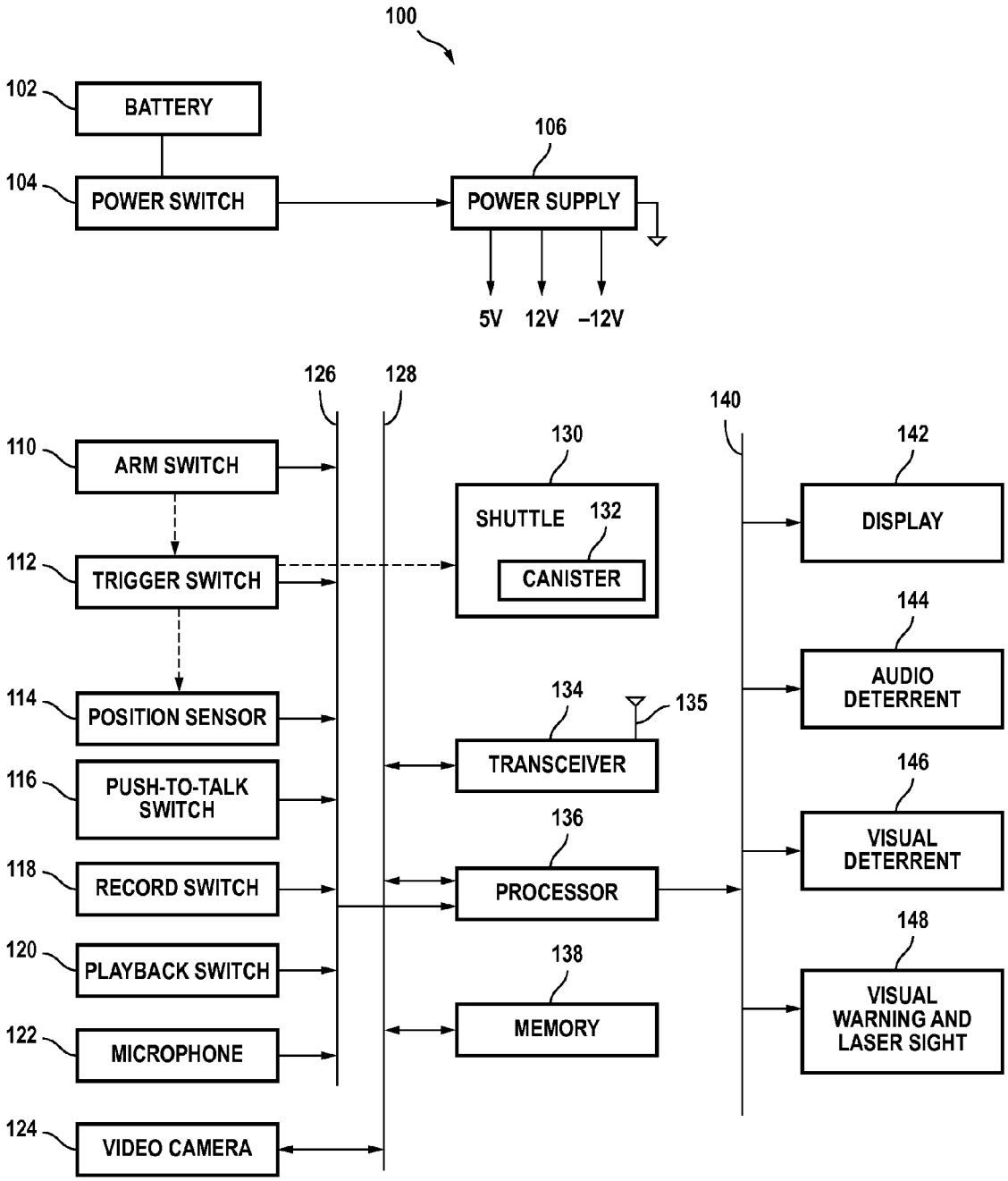
FIG. 1 is a functional block diagram of a system for spraying according to various aspects of the present invention.

A system for spraying includes any apparatus that dispenses aerosol and comprises a user interface. A user may include a human operator. A user may include a robotic apparatus. A user interface includes any apparatus for initiating spraying.

A system for spraying, according to various aspects of the present invention, supports a canister that contains an aerosol and activates release of the aerosol from the canister in response to a range of positions of a trigger switch. In one implementation as a hand-held, hand-operated device or spray gun, a human user operates the trigger switch to cause activation and directs the aerosol.

According to various aspects of the present invention, a user of a system for spraying comprising a trigger switch experiences a change in the force vs. position of the trigger switch preceding activation of release of the aerosol. A possibility of unintended activation is reduced. Training on use of the system is simplified. In an implementation where the system includes circuitry for functions in addition to releasing aerosol, operation of the trigger switch up to the position where a change in force is experienced may facilitate, initiate, or perform one or more of those functions. Operation of the trigger switch may facilitate, initiate, or perform a series of functions wherein the series is determined at least in part by a series of positions of the trigger switch.

According to various aspects of the present invention, a system for spraying provides a user interface that includes a power switch, an arm switch, and a trigger switch. The system comprises circuitry for one or more of the following functions: with audio and/or light, warn of subsequent release of aerosol; cast light for illumination and/or direction identification before and/or during release of aerosol; log date, time, and/or location of release of aerosol; record sound; record still photographs; record video; provide notice via cellular telephone; and/or facilitate communication via cellular telephone. Operation of the power switch accomplishes initialization of the circuitry. Initialization may include facilitating operation of the system as a node of a wireless network. The arm switch in a first position mechanically interferes with operation of the trigger switch and in a second position permits unrestricted operation of the trigger switch. Before operation of the power switch or in the absence of sufficient power (e.g., no available power source, dead battery), activation of release of aerosol can be accomplished in response to operation of the trigger switch as permitted by the arm switch.

According to various aspects of the present invention, a system for spraying provides a user interface that includes a microphone, a speaker, a record switch, and a playback switch. The record switch initiates recording of sound via the microphone. The playback switch initiates playback of recorded sound via the speaker. In various implementations, the recorded sound may be used for one or more of the following: recording of the user's voice identifies the user of the system; recording of a system administrator's voice advises the user for the purpose of system status messages (e.g., warranty expiration date, periodic maintenance due date, initial battery capacity, initial aerosol capacity, description of installed aerosol, date of dispensing the system to the user, warnings, operating instructions directed to the user). Recorded sound, recorded via the microphone and/or prerecorded by the system administrator or system manufacturer, may be used during operation of the system (e.g., as a warning preceding activation of release of aerosol, as notice via a wireless network, as notice via cellular telephone communication). Pre-recordings may comprise data for synthesizing sounds.

According to various aspects of the present invention, a system for spraying provides a user interface that includes a power switch, a second switch, and circuitry including a processor and a transceiver for communication. The system, when operational, performs a method for linking in advance of communicating notice as discussed above. By linking in advance, notice is more timely transmitted. In one implementation, the method begins when the power switch enables power to the processor. The method performed by the processor from indicia of instructions read by the processor from a memory includes in any practical order: (a) detecting operation of the second switch; (b) establishing a communication link via the transceiver; (c) reducing power consumption of the system; and (d) transmitting via the link in response to the second switch. For example, the second switch may be operated or held in position by the user when the power switch is being operated or within a predefined period thereafter. In one implementation, the link supports Bluetooth™ protocol (a trademark of Telefonaktiebolaget LM Ericsson). Establishing the link comprises discovering and/or responding so as to be paired with another Bluetooth capable device (e.g., a cell phone, tablet, laptop, hotspot). Reducing power consumption may include entering a sleep mode of the processor, memory, or related circuitry, reducing the range and/or recurring rate of transmitting, reducing the sensitivity of receiving, and/or removing power from portions of the circuitry of the system.

For example, system 100 of FIG. 1 is a system for spraying as discussed above. A functional block diagram of system 100 includes battery 102, power switch 104, power supply 106, arm switch 110, trigger switch 112, position sensor 114, push-to-talk switch 116, record switch 118, playback switch 120, microphone 122, video camera 124, shuttle 130, canister 132, transceiver 134, antenna 135, processor 136, memory 138, displays 142, audio deterrent 144, visual deterrent 146, and visual warning 148. Mechanical apparatus and circuitry of system 100 may be constructed of conventional materials using conventional technologies including conventional computer programming technologies in light of the disclosure herein.

A user interface includes switches and may further include displays. A switch includes any mechanical and/or electrical apparatus of a user interface that has than one position or state. Movement from one state to another is generally responsive to action by the user. For example, system 100 may include conventional switches (e.g., slide, toggle, push-on/push-off, normally open momentary, normally closed momentary, magnetic proximity, optical, capacitive).

A display provides an indication to the user. The indication may describe a configuration, a capability, a condition, a status, an operating mode, a result of an operation, and/or a warning. For example, displays of system 100 may include conventional indicators (e.g., lamps, light emitting diodes, liquid crystal displays, field emission displays, displays comprising selectively excited phosphor surfaces).

System 100 comprises a user interface that includes power switch 104, arm switch 110, trigger switch 112, position sensor 114, push-to-talk switch 116, record switch 118, playback switch 120, and displays 142. Trigger switch 112 performs mechanical functions with respect to shuttle 130. Trigger switch 112 and position sensor 114 cooperate to perform electrical functions. Arm switch 110 performs mechanical functions with respect to trigger switch 112 and performs electrical functions as discussed below.

A power switch includes any electrical switch that has an 'off' position and an 'on' position. For example, power switch 104 selectively electrically couples battery 102 to power supply 106. Power is supplied to power supply 106 only when power switch 104 is set to the 'on' position. In one implementation, power switch 104 is a two-position slide switch that is not biased into either position, and includes mechanical hysteresis to maintain its current position.

An arm switch includes any apparatus for mechanical and electrical functions discussed herein. For example, arm switch 110 has two positions: a 'safety' position; and a position away from the 'safety' position. The second position may correspond to the safety-off position of conventional hand guns. In one implementation, arm switch 110 is a two-position rotary switch that is not biased into either position, and includes mechanical hysteresis to maintain its current position. An arm switch includes any apparatus that further mechanically interferes with operation of a trigger switch.

A trigger switch includes any apparatus having a first position electrically sensed and providing movement for proportional control. For example, trigger switch 112 has a 'rest' position, a first range of positions that includes a 'first deterrent' position, and a 'second deterrent' range of positions that facilitate proportional release of aerosol spray. Trigger switch 112 is biased to the 'rest' position. Arm switch 110 in its 'safety' position mechanically holds trigger switch 112 in the 'rest' position to reduce the possibility of unintended operation of trigger switch 112. Trigger switch 112 cooperates with position sensor 114 so that a signal of position sensor 114 in accordance with obtaining the 'first deterrent' position effects circuitry of system 100.

A push-to-talk switch, a record switch, and a playback switch include electrical switches implemented with or without latches that maintain an output signal or mode. For example, a user's manual momentary press and release of the respective switch may initiate a talk function, a record function, or a playback function until the user's manual second press and release of the respective switch. Latching may be accomplished with circuitry and/or software using conventional technologies. Push-to-talk switch 116, record switch 118, and playback switch 120 may be implemented as monetary electrical switches that are biased into a 'rest' position and require action by the user to set each into a respective 'active' position. Without a latch function, the user obtains the indicated function only while holding the momentary electrical switch in its 'active' position.

System 100 can operate without current from battery 102 as follows. Arm switch 110 in 'safety' position mechanically blocks effective movement of trigger switch 112. A user may at any time move arm switch 110 out of the 'safety' position. After arm switch 110 is no longer in the 'safety' position, a user may at any time operate trigger switch 112 away from the 'rest' position to one or more other positions. When not in the 'rest' position, trigger switch 112 may mechanically urge shuttle 130 against force (e.g., one or more springs biased against trigger switch 112, one or more springs biased against shuttle 130, one or more springs biased against canister 132, one or more springs biased against valves normally closed to retain aerosol within canister 132). As shuttle 130 moves in response to movement of trigger switch 112, valves in a spray subsystem (an example of which is discussed below) open to release aerosol from canister 132 as a spray output of system 100. If the user does not overcome spring biasing, that biasing returns valves in spray subsystem closed to stop the release of aerosol.

System 100 is designed for battery-powered operation so that it can be carried and used apart from other sources of electricity. If desired, battery power may be replaced with a wired source of electricity, for example, with a sufficiently long and flexible cord to permit release of aerosol from suitable locations and in suitable directions.

Battery 102 provides power to system 100 when power switch 104 is set to the 'on' position and does not supply power when power switch 104 is set to the 'off' position. Battery 102 may be rechargeable in situ with conventional circuitry, not shown. Any conventional battery may be used.

A power supply includes any circuitry for converting power in one format to power in another format, each format, for example, has a characteristic (e.g., voltage amplitude; pulse period, repetition rate and duty cycle) suitable for empowering one or more functions of system 100. For example, power from battery 102 is converted by power supply 106 to +5 volts DC and +/−12 volts DC measured with respect to system ground (e.g., circuit common). These voltages supply power as needed to other functional blocks of system 100.

A processor includes any digital circuitry that performs a program stored in memory. A memory includes any conventional electronic and/or mechanical apparatus for storing digital information (e.g., RAM, ROM, Flash EPROM, disk). Memory circuits may be packaged with processor circuits as a controller, a microcontroller, a microprocessor, or a microcomputer. A processor may include input/output (I/O) circuitry for conversion of signaling technologies (e.g., analog, binary digital signals of nonstandard formats, impedance matching, latched inputs, latched outputs).

A transceiver includes any circuitry for sending and receiving wireless communication. Communication includes any conventional circuitry for suitable carriers, modulations, demodulation, packetization, and protocols.

According to various aspects of the present invention, system 100 performs a method for linking in advance of communicating notice as discussed above. By linking in advance, notice is more timely transmitted. In one implementation, the method begins when power switch 104 enables power supply 106 to energize processor 136, memory 138, and transceiver 134. The method performed by processor 136 in response to reading indicia of instructions from memory 138 includes in any practical order: (a) detecting operation of push-to-talk switch 116; (b) establishing a communication link via transceiver 134; (c) reducing power consumption of the system; and (d) transmitting via the link in response to push-to-talk switch 116. For example, push-to-talk switch 116 may be operated or held in position by the user when power switch 104 is set to the 'on' position or within a predefined period thereafter. In one implementation, the link supports Bluetooth™ protocol (a trademark of Telefonaktiebolaget LM Ericsson). Establishing the link comprises discovering and/or responding so as to be paired with another Bluetooth capable device (e.g., a cell phone, tablet, laptop, hotspot). Reducing power consumption may include entering conventional sleep modes of processor 136, memory 138, and/or related circuitry, reducing the range and/or recurring rate of transmitting, reducing the sensitivity of receiving, and/or removing power from portions of the circuitry of system 100.

System 100 determines a notice that may at various times be customized and/or personalized to each user. To that end, processor 136 performs a method in accordance with indicia of instructions stored in memory 138. After power is being supplied by power supply 106, the user may set record switch 118 to the 'record' position. Speech or other audio is accepted by microphone 122 and indicia of audio is recorded in memory 138 as data for a notice. Microphone 122, processor 136, and/or memory 138 may include analog to digital conversion capability. Recording stops when memory capacity is filled and/or when record switch 118 is no longer in the 'record' position. The user may review the recorded notice by setting playback switch 120 to the 'playback' position. Indicia of audio, recalled from memory 138 may be formatted and directed to drive audio deterrent 144, a conventional speaker, and/or be transmitted by transceiver 134 for review on a suitable receiver (e.g., cellular telephone, tablet, laptop computer). One purpose of the notice may be to inform an emergency assistance service as discussed below.

In addition to transmitting audio notice over a link as discussed above, system 100 transmits audio over a link in response to arm switch 110, trigger switch 112, and/or push-to-talk switch 116. In one implementation processor 136 performs a method in accordance with instructions stored in memory 138, after power is being supplied by power supply 106. Processor 136 monitors the position of arm switch 110. When arm switch 110 is no longer in the 'safety' position, processor 136 records sound from microphone 122 as data stored in an audio circular buffer in memory 138 that keeps about 30 seconds of recorded sound. If trigger switch 112 is moved against spring bias out of a 'rest' position to a 'first deterrent' position, processor 136, in any practical order, activates audio deterrent 144, activates visual deterrent 146, activates visual warning 148, activates video camera 124 and records video into a video circular buffer in memory 138 that keeps about 15 minutes of video, issues instructions over the link established as discussed above to a cellular phone to place a call to an emergency assistance service (e.g., a 9-1-1 service), and performs playback of the recorded notice created as discussed above to inform the emergency assistance service. If a cellular phone call has been established, then processor 136 may facilitate transmitting over the cellular phone call audio from any one (e.g., alternatingly) of the following sources: recorded sound from the audio circular buffer in memory 138, the recorded notice, live ambient sound responsive to microphone 122, and live speech or sound responsive to microphone 122 further in response to push-to-talk switch 116 being held at the 'talk' position. Processor 136 may silence audio deterrent 144 in response to push-to-talk switch 116 being held at the 'talk' position.

Inputs to processor 136 may be coupled to processor 136 in any conventional manner, represented generally by bus 126. Various additional circuitry (not shown) may be used (e.g., discrete circuitry for each input, de-bounce circuits, sampling circuits, multiplexers, addressed I/O logic, analog to digital conversion circuitry, comparators, amplifiers, digitizers).

Conventional digital communication is supported by bus 128 and any conventional protocols. Video camera 124, transceiver 134, processor 136, and memory 138 may read and/or write data from and to any suitable combination of these devices. Data may include status, commands, responses, acknowledgements, packets, and information to facilitate any function of system 100 as discussed herein.

Outputs from processor 136 may be coupled to processor 136 in any conventional manner, represented generally by bus 140. Various additional circuitry (not shown) may be used (e.g., discrete circuitry for each output, latching circuits, multiplexers, addressed I/O logic, digital to analog conversion circuitry, amplifiers).

An audio deterrent produces sound to frighten, distract, or debilitate a human or animal and is activated by the user for purposes of self-defense. Any conventional sound deterrent technology may be used including high volume, volume bursts, high pitch, low pitch, imitations of frightening sounds such as sirens, whistles, screams, or the ranting of attacking animals. For example, audio deterrent 144 produces an 80 dB siren howl.

A visual deterrent produces light to frighten, distract, or debilitate a human or animal, and is activated by the user for purposes of self-defense. Any conventional light deterrent technology may be used including temporarily blinding light, rapidly flashing light, imitations of frightening lights such as colors used exclusively by police and laser colors associated with weapon sights. For example, visual deterrent 146 emits high intensity white strobe light to cause temporary blindness and/or disorientation.

A visual warning may be emitted in any direction to inform other persons within a reasonable range of system 100 that deterrents including sound, light, and aerosol spray may be activated without further notice. For example, visual warning 148 may emit a suitable color (e.g., yellow, orange, red) of incoherent light to the left and to the right of system 100.

According to various aspects of the present invention, system 100 responds differently to more than one position of trigger switch 112 in addition to the 'rest' position. As discussed above, trigger switch 112 may have a 'first deterrent' position and a 'second deterrent' range of positions. Functions of system 100 initiated by trigger switch 112 entering the 'first deterrent' position (regardless of how long trigger switch 112 remains in the 'first deterrent' position) may be as discussed above. Aerosol spray may be initiated and continued while trigger switch 112 remains in the 'second deterrent' range of positions.

A position sensor detects and reports indicia of position of an object in any conventional manner of detecting and reporting. Position may be determined directly, or determined from velocity or acceleration of the object and reported directly as position or as velocity or acceleration according to conventional position sensor technologies. A position sensor may include conventional magnetic (e.g., proximity of a magnet or magnetically permeable material) and/or optical technologies (e.g., intensity of a light source or reflection, beam break).

For example, position sensor 114 detects magnetic flux associated with a portion of trigger switch 112. When magnetic flux intensity or a rate of change thereof crosses a predetermined limit value, then position sensor 114 informs (e.g., writes) or makes data available (e.g., awaits being read) to inform processor 136 to the effect that trigger switch 112 has entered the 'first deterrent' position.

A shuttle includes any mechanism that locates a canister for proper initiation of aerosol output from the canister in response to (e.g., directly, indirectly, in accordance with position of) a trigger switch. A shuttle may retain a canister. A shuttle may locate and/or retain more than one canister. A canister may comprise a valve operated in response to movement of the shuttle. A canister may comprise a vent opened in response to movement of the shuttle. A shuttle may seal a canister and operate to open the seal in response to movement of the shuttle. A vent, valve, or seal may be re-closeable or non-recloseable.

For example, shuttle 130 retains canister 132 and moves canister 132 so as to open a valve that may be integral to canister 132. Movement is against spring bias in the valve so that when shuttle 130 returns to a 'rest' position, the valve recloses. Movement in a range of positions of shuttle 130 may facilitate proportionally opening the valve for proportionally more or less volume and/or velocity of output spray.

The functions discussed herein for a canister may be integrated into an aerosol-containing shuttle for an implementation that omits a separable canister.

System 100 in one implementation is a weapon designed to be hand-held, battery operated, and used for self-defense. Weapon 200 is not a firearm and is unlikely to be a sole cause of death or serious injury of humans. For example, as shown in FIGS. 2-6, weapon 200 includes features corresponding generally to the functional blocks discussed above. Functional blocks are indicated parenthetically for reference. Weapon 200 includes enclosure 202, handle 204 (e.g. an integral portion of enclosure 202), base 206, and front face 208 (e.g. an integral portion of enclosure 202). Weapon 200 encloses spray subsystem 300 (see FIG. 3A). On front face 208 are located lens 207 for a visual deterrent (146) and a video camera (124), a radiator 209 for an audio deterrent (144), visual warning (148) 205, laser sight (148) 210, and spray outlet 211. A user interface of weapon 200 includes trigger switch (112) 212, arm switch (110) 213, power switch (104) 218, record switch (118) 222, playback switch (120) 220, push-to-talk (116) switches 214 and 216, and displays (142) 224. For ambidextrous operation, arm switch 213 and push-to-talk switches 214 and 216 have mechanical and/or electrical equivalents positioned equivalently on both sides of weapon 200. A circuit board (omitted for clarity of description of spray subsystem 300) includes circuitry for all functions discussed with reference to FIG. 1, namely, a power supply (106), microcontroller (136, 138), transceiver (134), antenna (135), circuitry for audio and visual deterrents (144, 146), microphone (122), and video camera (124).

A user may perform a method of operating the system including: removing base 206; installing a canister 318 of aerosol spray (e.g., pepper spray); installing a battery (102) 319; and replacing base 206. If battery 319 is absent or not sufficiently charged, aerosol spray may be dispensed mechanically by moving arm switch 213 away from a 'safety' position; directing spray outlet 211 of front face 208 toward a human or animal to be sprayed; and controlling the dispensing of aerosol spray by pulling and releasing trigger switch 212.

If the battery has sufficient charge to operate circuitry of system 100 including a processor and display, system 100 may respond to the user's act of sliding power switch 218 to the 'on' position by illuminating display 224 as notice that no communication link has been established. The processor performs a method similar in some ways to the method discussed above including detecting whether push-to-talk switch 214 or 216 is operated by the user within a limit period of time relative to operation of power switch 218. If not, then the processor operates display 224 to provide notice to the user (e.g. red light is emitted).

If the battery has sufficient charge to operate circuitry of system 100 including a processor and a transceiver, the system may respond to the user's act of sliding power switch 218 to the 'on' position and operating push-to-talk switch 214 or 216 within a limit period of time by: (a) establishing a communication link via a transceiver of the system circuitry; and (b) reducing power consumption of the system. The processor may control the transceiver with a signal or command to reduce power consumed by the transceiver; and the processor may change to a low power mode (e.g., sleep mode) where transition out of the sleep mode may be responsive to setting arm switch 106 to an arm position. During low power mode, the communication link (e.g., pairing) is maintained ready for immediate use (e.g., without repeating steps of initializing, discovering, identifying, configuring, verifying configuration).

A spray subsystem, according to various aspects of the present invention, facilitates activation of a series of deterrents. For example, a series comprising one or more first deterrents followed in time by second deterrents as discussed herein.

A spray subsystem, according to various aspects of the present invention facilitates a series of functions of a system for spraying. For example, a system for spraying performs a series of functions including initializing a communication capability, operating a communication capability, operating an incident recording capability, and releasing aerosol spray. A spray subsystem, according to various aspects of the present invention comprises a shuttle and a trigger switch wherein the shuttle and the trigger switch cooperate with discontinuous mechanical coupling. According to various aspects of the present invention, the trigger switch may provide a discontinuity in bias against operation of the trigger switch by the user. These aspects are realized in a spray subsystem 300 of FIGS. 3A-3E, 4, and 5.

Figure 2A:
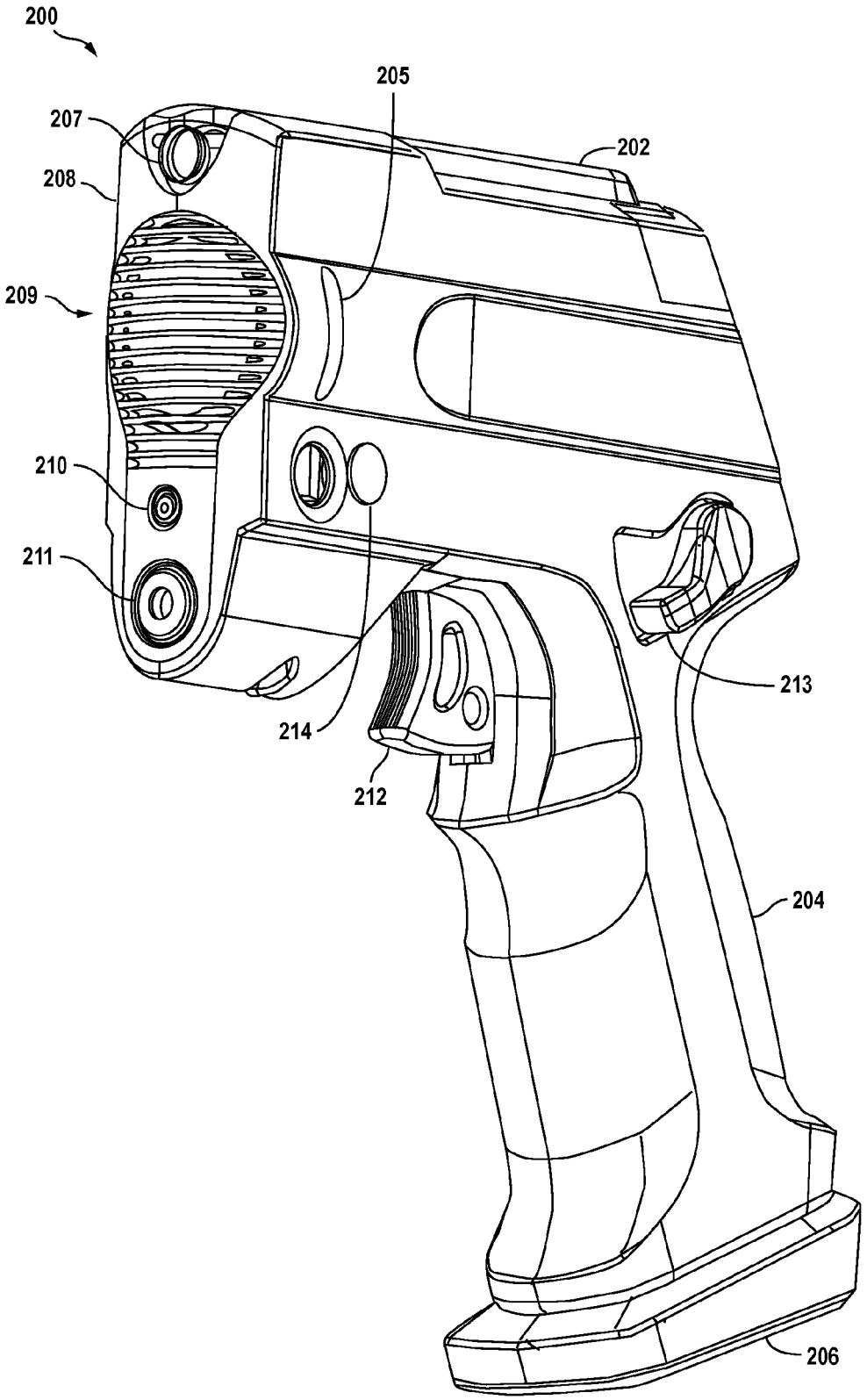
FIG. 2A is a perspective plan view of a system for spraying in one implementation according to various aspects of the present invention showing the left side and front.
Figure 2B:
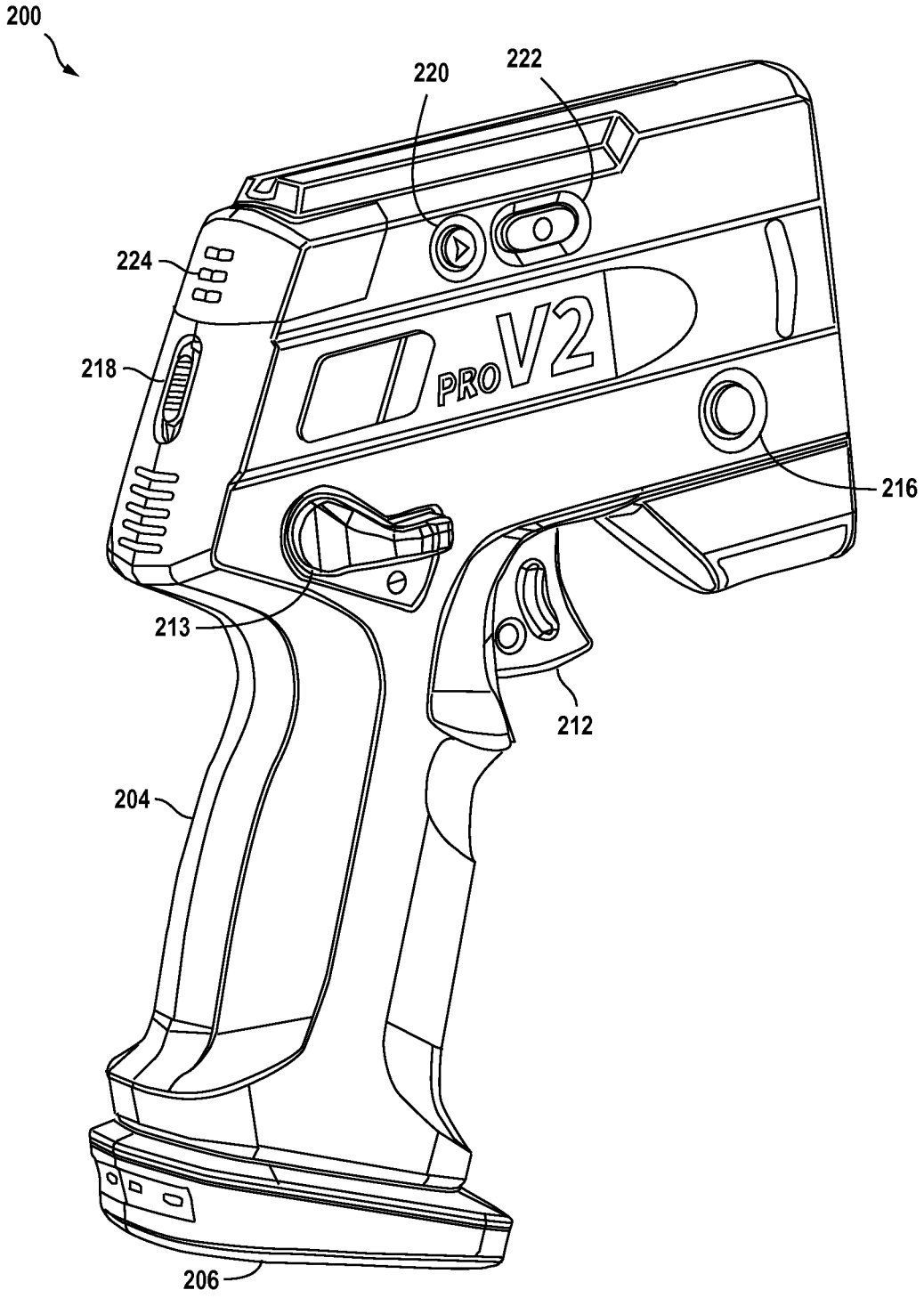
FIG. 2B is a perspective plan view of a system for spraying in one implementation according to various aspects of the present invention showing the right side and rear.

Spray subsystem 300 is located within enclosure 202 of weapon 200 shown in FIGS. 2A and 2B. Spray subsystem 300 includes exit valve 302, tube 304, entry valve 314, trigger switch 212, shuttle 320, and canister 318 having canister outlet valve 316. In the side view of FIG. 3A, spray subsystem 300 is located against the inside surface of left side 203 of enclosure 202. Stop 317 maintains alignment of entry valve 314 and canister outlet valve 316.

Figure 3A:
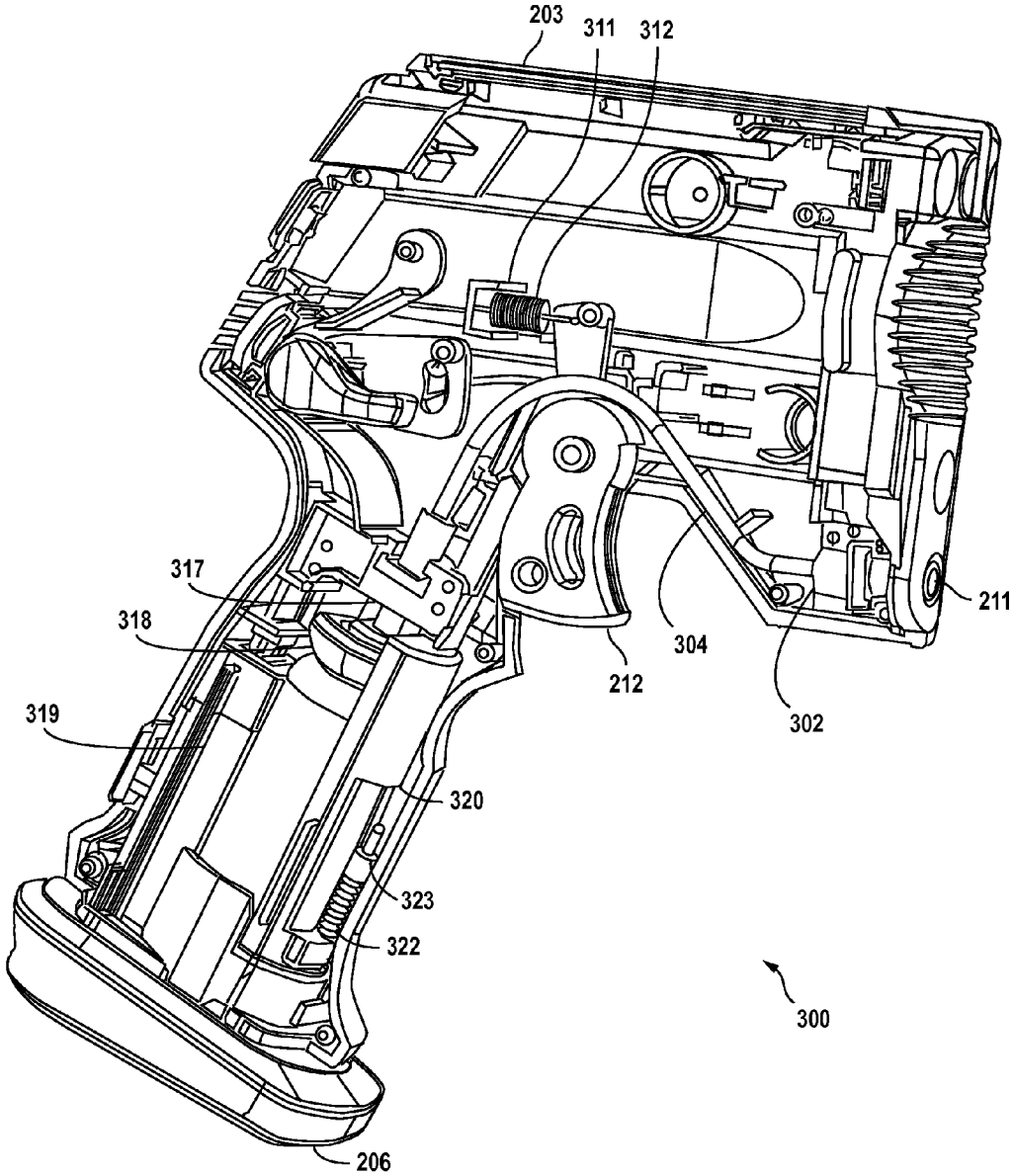
FIG. 3A is a plan view of the interior of the left half of the housing of the system of FIGS. 2A and 2B.
Figure 3B:
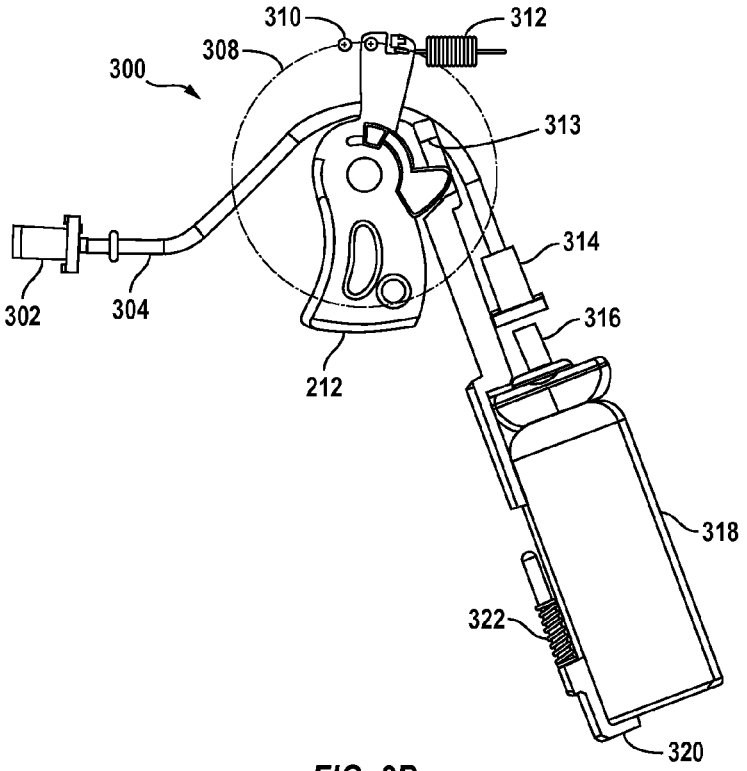
FIGS. 3B-3E are partial cross section views of a spray subsystem of the system for spraying of FIGS. 2A and 2B with the trigger switch at rest, the trigger switch at a first position, the trigger switch at a second position, and the trigger switch at a third position, respectively.
Figure 3C:
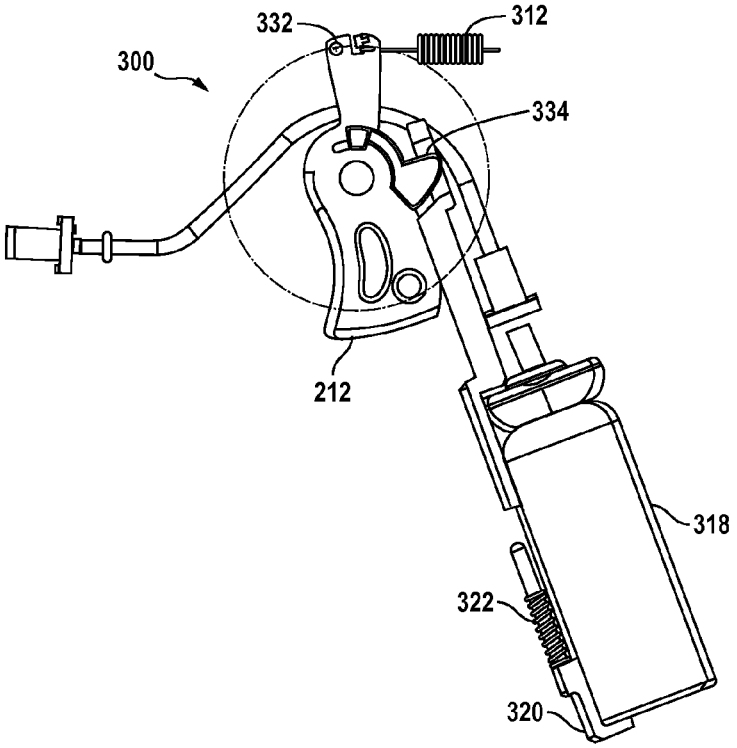
Figure 3D:
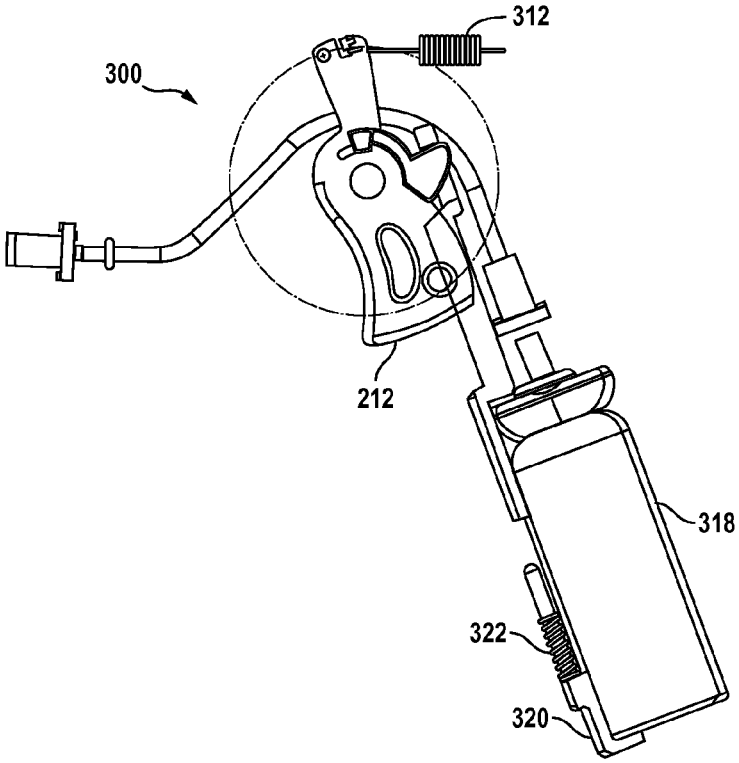
Figure 3E:
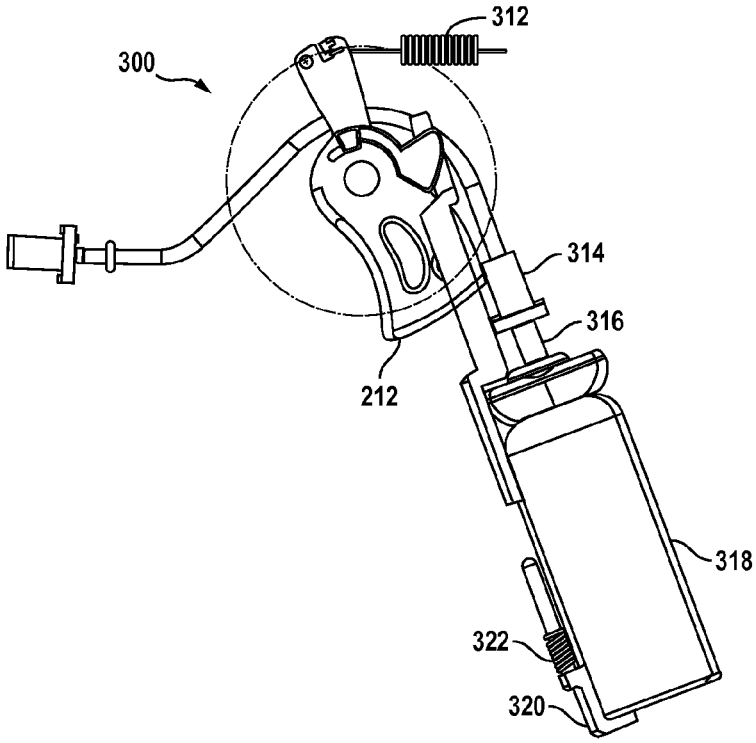
Figure 4:
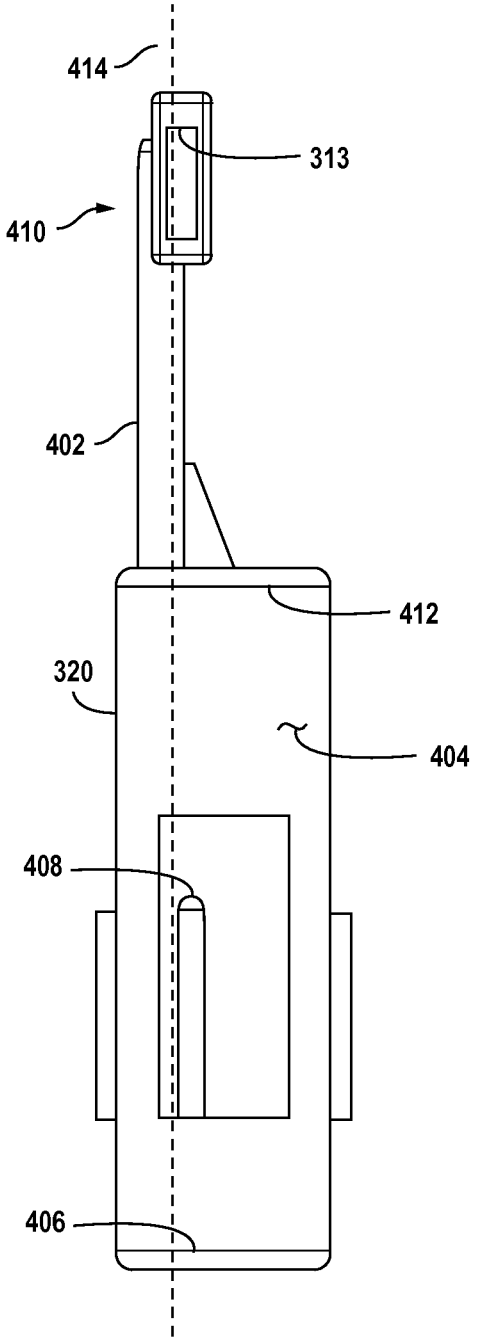
FIG. 4 is a front plan view of a shuttle of the spray subsystem of FIGS. 3B-3E.
Figure 5:
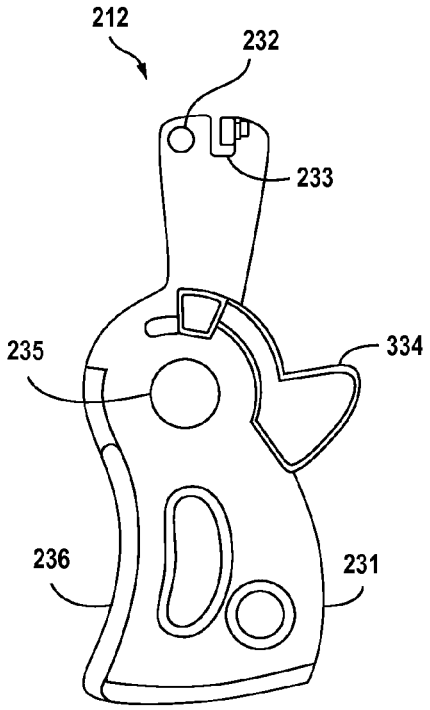
FIG. 5 is a left side view of a trigger switch of the spray subsystem of FIGS. 3B-3E.

In the partial cross section views of FIGS. 3B-3E, shuttle 320 is shown in a section identified by plane 414 in FIG. 4. Canister 318 is shown supported by shuttle 320 and in a section with reference to the same plane 414.

A valve, as discussed herein, includes any conventional check valve for a fluid (e.g., gas, liquid, suspension, aerosol). For example, canister outlet valve 316, entry valve 314, and exit valve 302 may comprise duck-bill check valves that open in response to a prescribed minimum pressure and otherwise close in response to bias of the valve design. Bias may be provided by a spring or any other conventional materials or components.

A tube includes any structure having a passage that transports a fluid. Tube 302 may be rigid, formed of stainless steel.

With reference to FIGS. 3B-E, when the user applies pressure to trigger switch 212, trigger switch 212 pivots into abutting contact with shuttle 320. After contact occurs, continued pressure by the user on trigger switch 212 causes trigger switch 212 to urge shuttle 320 upward. As shuttle 320 moves upward, shuttle 320 lifts canister 318. As canister 318 is lifted, canister 318 compresses canister outlet valve 316 against entry valve 314 and thereby opens canister outlet valve 316. Pressure of the aerosol opens entry valve 314 and exit valve 302. When canister outlet valve 316 is open, aerosol spray travels through canister outlet valve 316, entry valve 314, tube 304, exit valve 302, and spray outlet 211 of front face 208.

Operation of spray subsystem 300 will now be further described with reference to FIGS. 3B-3E and FIG. 6. In FIG. 3B, trigger switch 212 is at the 'rest' position indicated as X0 in graph 600. In FIG. 3C, trigger switch 212 is at a 'first deterrent' position indicated as X1 in graph 600. In FIG. 3D, trigger switch 212 is at a beginning of a range of positions indicated as X2-X3 in graph 600. In FIG. 3E, trigger switch 212 is at an end position X4 of a 'second deterrent' range of positions indicated as X3-X4 in graph 600.

Spray system 300 further includes trigger bias spring 312. Trigger bias spring 312 provides a trigger bias spring bias force that maintains trigger switch 212 in 'rest' position X0 by opposing force (if any) exerted by the user of weapon 200 to move trigger switch 212 away from 'rest' position X0.As trigger switch 212 pivots at the center of reference circle 308, trigger bias spring 312 extends, increasing this trigger bias spring bias force.

Spray system 300 further includes shuttle bias spring 322. Shuttle bias spring 322 provides a bias force that maintains shuttle 320 at a 'rest' position to assure opening of canister outlet valve 316 is intended by the user of weapon 200. When shuttle bias spring 322 is compressed against stop 323, shuttle 322 is urged by shuttle bias spring 322 to return to its 'rest' position as shown in FIGS. 3A-3D.

Canister outlet valve 316 has a return spring (not shown). This return spring cooperates with shuttle bias spring 322 to provide a combined bias against force exerted by the user of weapon 200 against trigger switch 212. According to various aspects of the present invention, the combined bias increases at a rate different (e.g., greater) than the trigger bias spring bias force discussed above. Consequently, a first increasing force exerted by the user to move trigger switch 212 in a first range of positions X0-X2 is noticeably at a different rate of increase than a second increasing force exerted by the user to move trigger switch 212 in a second range of positions X2-X4. In other words, in an exemplary implementation, the respective spring constants of trigger bias spring 312, return spring of canister outlet valve 316, and shuttle bias spring 322 are designed to generally provide the force vs. position relationship of graph 600 where forces F0-F4 represent a series of ever increasing forces matched by the user of system 100 to attain and/or leave trigger switch positions X0-X4.

Figure 6:
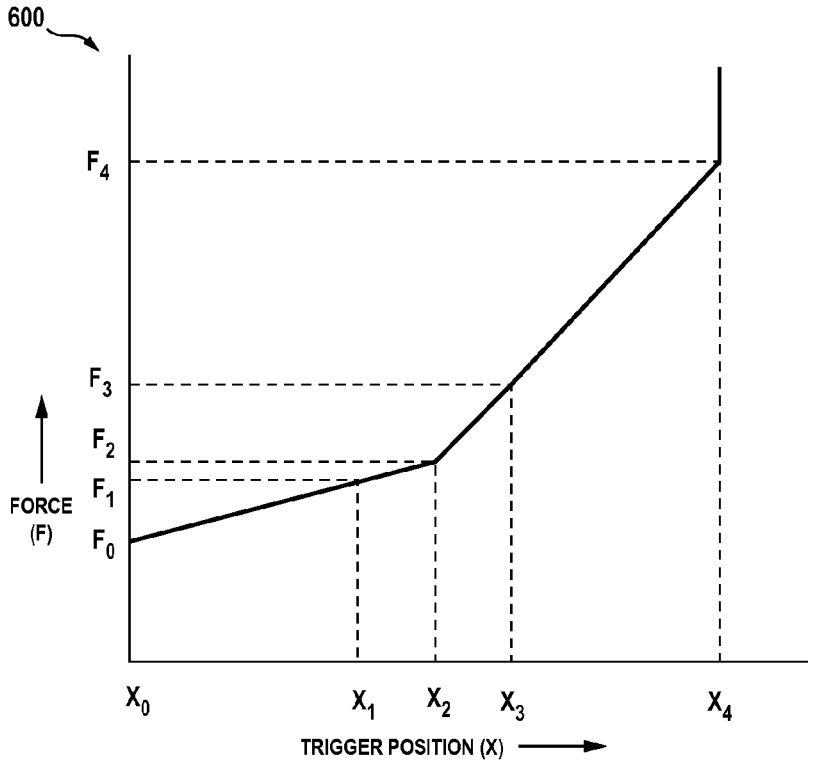
FIG. 6 is a graph of force vs. position of a trigger switch of the system for spraying of FIG. 1 and the implementation of a system for spraying of FIGS. 2A, 2B, 3A-3E, 4, and 5.

The graph of FIG. 6 presents a simplified linearized approximation of the reaction force F that a user of weapon 200 would experience when applying pressure against trigger switch 212 at various angular positions X0-X4 measured about the center of circle 308. A model of the actual force as a function of position X would account for nonlinear stretching of trigger bias spring 312 and nonlinear compression of shuttle bias spring 322 for values of X from X0-X4.

A position sensor may include a fixed portion and a moving portion. A fixed portion of position sensor 310 is mounted on a circuit board (not shown) and located on reference circle 308. A moving portion comprises magnet 332 of trigger switch 212. As trigger switch 212 moves into 'first deterrent' position X1, magnet 332 operates the fixed portion to indicate to circuitry that the 'first deterrent' position has been accomplished. The fixed portion of position sensor 310 comprises a conventional magnetic proximity switch. Circuitry including proximity switch 310 is coupled to a processor to notify the processor when trigger switch 212 is in the 'first deterrent' position.

Trigger switch 212 is coupled to shuttle 320 when surface 334 of trigger switch 212 abuts surface 313 of shuttle 320. Opening 410 of shuttle 320 comprising surface 313 accepts a portion of trigger switch 212 comprising surface 334. These surfaces are not mechanically coupled for cooperation when trigger switch 212 is in a first range of positions X0-X2. These surfaces are mechanically coupled for cooperation when trigger switch 212 is in a second range of positions X2-X4. Because there is no tactile feedback to the user at position X1 of trigger switch 212, the user learns that trigger switch 212 has achieved the 'first deterrent' position X1 and is now beyond position X1 when tactile feedback is available at position X2. The range of positions X1-X2 accommodates manufacturing tolerances. The range of positions X1-X2 when greater than about 10% of the range X0-X2 makes system 100 easier to use, for instance because proper operation is less dependent on the user moving trigger switch 212 to a narrowly defined position such as X1 itself. The range of positions X1-X2 can be made greater than about 10% of the range X0-X2 by conventional design techniques for the size and shape of trigger switch 212 relative to the position and size of opening 410 of shuttle 320.

A shuttle may include a base for lifting a canister, and an operative surface for coupling to a trigger switch. The base and operative surface may be in fixed relationship. For example, the base and operative surface may be features of a rigid structure that forms the shuttle. In one implementation, shuttle 320 is rigid, formed of conventional plastic.

The operative surface of the shuttle comprises any portion of the shuttle that cooperates (e.g., abuts, impinges) with a portion of a trigger switch. The operative surface may be an inside surface of a feature (e.g., aperture, hook, L-shape, box, cup, loop). The trigger switch may, after coming into contact with the operative surface of the shuttle, form a coupling (e.g., hinge, joint, ball and socket). Mechanical coupling of the operative surface and the trigger switch may include abutting, sliding, and/or impinging. The operative surface may be located on the shuttle at a distance away from the canister. The operative surface may be located beside the canister. The operative surface may be located on the shuttle at a distance above or below the canister.

The base of a shuttle includes an surface capable of urging open the canister outlet valve. The base may abut a lower extremity of a canister (e.g., lift the canister by a surface of the canister abutting the shuttle when the shuttle is in a 'rest' position). A base may abut, grasp, and/or impinge a portion of a canister above the lower extremity (e.g., urge the canister to open the canister outlet valve by contact with a feature near the top, at a neck, and/or of a wall of the canister).

A spring, as used herein, includes any device that provides a mechanical force in response to a position or change of position. Spring includes any conventional spring (e.g., coil, leaf, torsion spring, flat wound, strip, cord) operative by extension, compression, bending, or twisting. A spring includes devices of conventional materials (e.g., solids, liquids, gels, gases) having resilient and/or elastic characteristics.

A shuttle bias spring includes any device coupled to a shuttle and/or any integral portion of a shuttle that provides a force to close a canister exit valve and/or return the shuttle to a 'rest' position.

For example, shuttle 320 includes base 406, post 408, top 412, and arm 402. Base 406 and top 412 define the vertical extent of interior space 404 sized for retaining a conventional canister containing under pressure an aerosol (e.g., oleoresin capsicum, pepper spray). Arm 402 comprises opening 410. A top portion of opening 410 is defined by surface 313 of arm 402. In operation, canister 318 abuts base 406 at all times. When shuttle 320 is lifted by trigger switch 212, shuttle 320 lifts canister 318 by force applied from base 406 to a lower extremity of canister 318. Pressure of surface 234 of trigger switch 212 is communicated through arm 402 to lift base 406 and canister 318. Post 408 confines shuttle bias spring 322 during compression of shuttle bias spring 322 against stop 323 as shuttle 320 moves away from its 'rest' position. Top 412 may abut a top surface of canister 318 to assure that canister outlet valve 316 is pulled away from entry valve 314 as shuttle 320 returns to its 'rest' position.

A trigger switch for operation in a spray subsystem according to various aspects of the present invention includes structure for position sensing, structure for cooperation with a trigger bias spring, and structure for cooperation with a shuttle. For example, trigger switch 212 of FIG. 5 includes switch body 231 and magnet 232. Switch body 231 includes features identified as mount 233, surface 234, aperture 235, and finger grip 236.

In one implementation, trigger switch 212 is an assembly. Switch body 231 is formed of rigid conventional plastic. Magnet 232 is pressed into position in a suitable aperture of switch body 231. Trigger bias spring 312 may be coupled to switch body 231 in any conventional manner (e.g., threaded into mount 233, threaded into a suitable aperture of body 231, mounted coaxially to oppose rotation of trigger body 231 about aperture 235).

Aperture 235 supports switch body 231 on a suitable post feature of body 203. Aperture 235 facilitates rotation of switch body 231 about a center of aperture 235 coaxial to circle 308 discussed above.

Finger grip 236 provides a comfortable surface for the user to operate trigger switch 212 with an index finger in a conventional manner.

In the implementations discussed above with reference to FIGS. 2A, 2B, 3A-3E, 4, and 5 body 202 includes handle 204 at an angle from a horizontal top portion of weapon 200. Trigger switch 212 provides rotational motion about circle 308 to open canister outlet valve 316. Space for a canister is provided in a handle of the weapon. Other implementations are within the scope of the present invention.

For example, a weapon having analogous functions supports a canister substantially parallel to the direction of spray. A trigger switch in such an implementation may operate by movement along a substantially straight line instead of about an axis of rotation as discussed above. Movement of the trigger switch may be confined to a track having any suitable linear or nonlinear form. A handle may be provided at an angle to the direction of spray, substantially parallel to the direction of spray, or omitted (e.g., for use against a human user's shoulder or for use by a robotic user).

For example, a canister may include a canister release valve that is opened using rotational force (in contrast with linear force for canister 318 discussed above). A trigger switch and shuttle may be arranged in linear format (e.g., similar to rack (trigger) and pinion (shuttle) coupling), arranged in coaxial coupling (both trigger and shuttle rotate on the same axis), or arranged in counter rotational coupling (analogous to the way two disc-shaped gears mesh on their circumferences).

In all of these alternatives, movement of the trigger switch causes movement of the shuttle only after an initial range of motion of the trigger switch (e.g., after a position analogous to position X2 of FIG. 6).

Examples of systems for spraying and methods performed by systems for spraying, according to various aspects of the present invention, include the following.

As a first example, a system for spraying includes a trigger switch, a first spring, a second spring, and a canister of aerosol. The first spring is coupled to the trigger switch to oppose operation of the trigger switch. The second spring is not coupled to the trigger switch during a first range of positions of the trigger switch and is coupled to the trigger switch during a second range of positions of the trigger switch. During the second range of positions of the trigger switch, the first spring and the second spring oppose operation of the trigger switch without release of the aerosol. During a third range of positions of the trigger switch, the first spring and the second spring oppose operation of the trigger switch in a range of positions with release of the aerosol.

As a second example, a variation of the first example, the system further includes a shuttle operative when coupled to the trigger switch to open the canister to release the aerosol; and during the first range of positions of the trigger switch, the shuttle is not coupled to move in response to the trigger switch.

In a variation of the second example, the second spring is coupled to the shuttle to oppose movement of the shuttle.

In another variation of the second example, the system is useful for self-defense against an attacker. The system further includes circuitry and a position sensor. The circuitry provides a deterrent to aggression by the attacker. The position sensor enables the circuitry to provide the deterrent after the trigger switch is operated beyond a first portion of the first range and before the trigger switch is operated in the second range.

In another variation of the first example, the system is useful for self-defense against an attacker. The system further includes circuitry and a position sensor. The circuitry provides a deterrent to aggression by the attacker. The position sensor enables the circuitry to provide the deterrent after the trigger switch is operated beyond a first portion of the first range and before the trigger switch is operated in the second range.

As a third example, a system for spraying includes a canister, a tube, a trigger switch, a first spring, and a second spring. The canister comprises an outlet valve biased closed. The tube comprises an entry valve and an exit valve. The first spring is biased to return the trigger switch to a rest position. The second spring is biased to return the canister to a rest position. Movement of the trigger by a user of the system when opposed by only the first spring does not open the outlet valve. Movement of the trigger by a user of the system when opposed by only the first spring and the second spring does not open the outlet valve. Movement of the trigger by a user of the system when opposed by the first spring, the second spring, and the bias of the outlet valve opens the outlet valve to form a spray comprising contents of the canister.

As a fourth example, a system for spraying includes a canister of aerosol, a circuit, and a trigger switch. The trigger switch provides a force as a function of position, the force opposing operation of the trigger switch by a user. The force increases at a first average rate in a first range from a rest position of the trigger switch to a tactile feedback position of the trigger switch. The force increases at a second average rate greater than the first average rate in a second range from the tactile feedback position to a maximum position of the trigger switch. The circuit is enabled to output an audio deterrent at a position within the first range spaced respectively from each extreme of the first range. The canister is opened to release aerosol in a portion of the second range that is less than the entire second range.

As a fifth example, a spray subsystem comprises a shuttle and a trigger switch. The shuttle and the trigger switch cooperate with discontinuous mechanical coupling. The trigger switch provides a discontinuity in bias against operation of the trigger switch by the user.

As a sixth example, a spray subsystem includes a shuttle and a trigger switch. The trigger switch moves in a first range of positions before abutting the shuttle. The trigger switch moves in a second range of positions while abutting the shuttle to move the shuttle. Movement of the trigger switch is opposed by a first spring. Movement of the shuttle is opposed by a second spring.

In a variation of the sixth example, a portion of the trigger switch passes through an opening of the shuttle before the trigger switch abuts the shuttle.

As a seventh example, a trigger switch for operation in a spray subsystem, includes a portion of a position sensor (e.g., a sensor, a characteristic capable of being sensed), a mount, and a surface. The position sensor senses the position of the trigger switch as operated by a user of the spray subsystem. The mount accepts a spring to oppose movement of the trigger by the user of the trigger switch. The surface mechanically cooperates with a provided canister to release a spray from the canister.

In a variation of the seventh example, the portion of the position sensor includes a magnet.

As an eighth example, a system for spraying for self-defense against an attacker includes a power switch, an arm switch, a trigger switch, circuitry, and a canister. The circuitry provides a notice via a wireless link and for recording audio and video of the attacker. The canister contains aerosol. The circuitry, in response to operation of the power switch, enables operation of the system as a node of a wireless network. The circuitry, in response to operation of the arm switch, records audio and video of the attacker. The notice is provided via the wireless link in response to operation of the trigger switch. The aerosol is released toward the attacker in response to operation of the trigger switch.

As a ninth example, a method is performed by a processor that reads indicia of instructions for the method from a memory. The processor and memory are part of a system operated by a user. The system further comprises a power switch, a second switch, and a transceiver. The method is performed when the power switch couples power to the processor and the memory. The method includes in any practical order, the steps of (a) detecting a first operation by the user of a second switch; (b) in response to detecting, establishing a communication link via the transceiver and reducing power consumption of the system; and (c) transmitting via the link in response to a second operation by the user of the second switch.

In a variation of the ninth example, the first operation of the second switch is detected if the second switch is held in position by the user within a predefined period after power is coupled to the processor.

In another variation of the ninth example, establishing the link comprises responding so as to be paired with a node of a network.

In another variation of the ninth example, reducing power consumption comprises entering a sleep mode of at least one of the processor and the memory.

In another variation of the ninth example, reducing power consumption comprises reducing a recurring rate of transmitting by the transceiver.

In another variation of the ninth example, reducing power consumption comprises reducing the sensitivity of receiving by the transceiver.

As a tenth example, a method is performed by a system for spraying. The system is operated by a user. The method includes in any practical order, the steps of (a) initializing a communication capability of the system in response to operation by the user of a first switch of the system; (b) operating a communication capability in response to operation by the user of a second switch; (c) operating an incident recording capability in response to operation by the user of a third switch; and (d) releasing aerosol spray in response to operation by the user of a fourth switch.

The foregoing description discusses preferred embodiments of the present invention, which may be changed or modified without departing from the scope of the present invention as defined in the claims. As used herein, the term 'coupled' is used for explaining cooperation (e.g., electrical communication, mechanical communication) that may be direct or indirect (e.g., through intervening mechanical, through intervening electrical components). As used herein, the term 'generally' is used for explaining a component or process in an implementation where in other implementations of the present invention each of the narrower terms 'substantially', 'primarily', and 'exclusively' is specifically intended to be disclosed and to apply. These relationships correspond to relative effectiveness of the component or process such as generally about 50% effective, substantially about 80% effective, primarily about 95% effective, and exclusively meaning 100% effective. The term 'about' means a factor of +/−15%. The examples listed in parentheses may be alternative or combined in any manner. The invention includes any practical combination of the structures and methods disclosed. As used in the specification and claims, the words 'having' and 'including' in all grammatical variants are open-ended and synonymous with 'comprising' and its grammatical variants. While for the sake of clarity of description several specifics embodiments of the invention have been described, the scope of the invention is intended to be measured by the claims as set forth below.

What is claimed is:

1. A system for self-defense against an attacker, the system comprising:

a. a trigger switch operative in sequence from a first position, through a second position, through a third position, and to a fourth position;

b. a first spring coupled to the trigger switch to oppose operation of the trigger switch, opposition being greater at the fourth position than at the first position;

c. a second spring not coupled to the trigger switch until the second position and coupled to the trigger switch from the second position through the third position and to the fourth position;

d. circuitry for providing a deterrent to aggression by the attacker;

e. a position sensor that senses the position of the trigger switch, the position sensor enables the circuitry to provide the deterrent after the trigger switch is operated beyond the first position and before the second position; and f. a canister containing an aerosol; wherein g. from the second position to the third position, the first spring and the second spring oppose operation of the trigger switch without release of the aerosol; and h. from the third position to the fourth position, the first spring and the second spring oppose operation of the trigger switch with release of the aerosol for spraying in self-defense.

2. The system of claim 1 wherein:

a. the system further comprises a shuttle operative when coupled to the trigger switch to open the canister to release the aerosol; and b. before attaining the second position, the shuttle is not coupled to move in response to the trigger switch.

3. The system of claim 2 wherein the second spring is coupled to the shuttle to oppose movement of the shuttle.

4. The system of claim 1 wherein:

a. the system further comprises a shuttle that supports the canister, the shuttle operative to open the canister to release the aerosol;

b. before attaining the second position, the trigger switch does not abut the shuttle to move the shuttle in response to the trigger switch; and c. after the attaining the second position, the trigger switch abuts the shuttle to move the shuttle in response to the trigger switch.

5. The system of claim 4 wherein a portion of the trigger switch passes through an opening of the shuttle before the trigger switch abuts the shuttle.

6. The system of claim 1 wherein the trigger switch comprises:

a. a mount that accepts the first spring to oppose operation of the trigger switch; and b. a surface mechanically coupled to the canister to release the aerosol from the canister.

7. The system of claim 6 wherein the position sensor comprises a magnet.

8. A system for self-defense against an attacker, the system comprising:

a. a canister containing an aerosol;

b. a circuit;

c. a trigger switch; and d. a position sensor that senses the position of the trigger switch; wherein:

e. the trigger switch provides a force as a function of position of the trigger switch, the force opposing operation of the trigger switch by a user;

f. the force increases at a first average rate throughout a first range from a rest position of the trigger switch to a tactile feedback position of the trigger switch;

g. the force increases at a second average rate greater than the first average rate throughout a second range from the tactile feedback position to a maximum position of the trigger switch;

h. the circuit is enabled by the position sensor to output an audio deterrent to aggression by the attacker at a position of the trigger switch that is within the first range spaced respectively from each extreme of the first range; and i. the canister is opened to release the aerosol for spraying in self-defense in a portion of the second range beginning beyond the tactile feedback position, wherein a volume of aerosol releasing increases as the force increases throughout the portion of the second range.

9. A system for self-defense against an attacker, the system comprising:

a. a circuit for providing a deterrent to aggression by the attacker;

b. a shuttle that supports a provided canister containing an aerosol;

c. a trigger switch; and d. a position sensor that senses the position of the trigger switch; wherein e. the trigger switch provides a force as a function of position of the trigger switch, the force opposing operation of the trigger switch by a user;

f. the force increases at a first average rate throughout a first range from a rest position of the trigger switch to a tactile feedback position of the trigger switch;

g. the force increases at a second average rate greater than the first average rate throughout a second range from the tactile feedback position to a maximum position of the trigger switch;

h. the trigger switch moves the shuttle to open the canister to release the aerosol for spraying in self-defense in a portion of the second range beginning beyond the tactile feedback position, wherein a volume of aerosol releasing increases as the force increases throughout the portion of the second range i. the position sensor enables the circuit to provide the deterrent after the trigger switch is operated beyond the rest position and before the tactile feedback position.

10. The system of claim 8 wherein:

a. the system further comprises a shuttle that supports the canister, the shuttle operative when coupled to the trigger switch, to open the canister to release the aerosol; and b. before the trigger switch attains the tactile feedback position, the shuttle is not coupled to move in response to the trigger switch.

11. The system of claim 10 wherein a spring is coupled to the shuttle to oppose movement of the shuttle.

12. The system of claim 8 wherein:

a. the system further comprises a shuttle that supports the canister, the shuttle operative to open the canister to release the aerosol;

b. before the trigger switch attains the tactile feedback position, the trigger switch does not abut the shuttle to move the shuttle in response to the trigger switch; and c. after the trigger switch attains the tactile feedback position, the trigger switch abuts the shuttle to move the shuttle in response to the trigger switch.

13. The system of claim 12 wherein a portion of the trigger switch passes through an opening of the shuttle before the trigger switch abuts the shuttle.

14. The system of claim 8 wherein the trigger switch comprises:

a. a mount that accepts a first spring to oppose operation of the trigger switch; and b. a surface mechanically coupled to the canister to release the aerosol from the canister.

15. The system of claim 8 wherein the position sensor comprises a magnet.

16. The system of claim 9 wherein before the trigger switch attains the second position, the shuttle is not coupled to move in response to the trigger switch.

17. The system of claim 9 wherein a spring is coupled to the shuttle to oppose movement of the shuttle.

18. The system of claim 9 wherein:

a. before the trigger switch attains the tactile feedback position, the trigger switch does not abut the shuttle to move the shuttle in response to the trigger switch; and b. after the trigger switch attains the tactile feedback position, the trigger switch abuts the shuttle to move the shuttle in response to the trigger switch.

19. The system of claim 18 wherein a portion of the trigger switch passes through an opening of the shuttle before the trigger switch abuts the shuttle.

20. The system of claim 9 wherein the trigger switch comprises:

a. a mount that accepts a first spring to oppose operation of the trigger switch; and b. a surface mechanically coupled to the canister to release the aerosol from the canister.

21. The system of claim 9 wherein the position sensor comprises a magnet.

22. A method performed by a hand-held system for deterring an attacker, the system including a trigger for operation by a user, the method comprising in order:

opposing the user's operation of the trigger with force that increases at a first rate from a first position of the trigger at rest to a second position;

activating a first deterrent for deterring the attacker, activating including enabling a circuit in response to a sensor of the position of the trigger to provide the first deterrent after the trigger is operated beyond the first position and before the second position;

opposing the user's operation of the trigger with force that increases at the first rate until the trigger attains a third position;

opposing the user's operation of the trigger with force that increases at a second rate until the trigger attains a fourth position, wherein the second rate is greater than the first rate; and activating a second deterrent for deterring the attacker after the trigger attains the fourth position, the second deterrent comprising an aerosol.

23. The method of claim 22 further comprising:

proportionally increasing release of the aerosol as the trigger is operated beyond the fourth position.

* * * * *